United States Patent [19]

Minor et al.

[11] 4,070,007

[45] Jan. 24, 1978

[54] PLASTIC FENCE POSTS AND ENCLOSURES

[75] Inventors: Dale R. Minor, Washington Township, Pickaway County; Byron W. Rose, Circleville Township, Pickaway County; William R. Vivian, Jackson Township, Franklin County, all of Ohio

[73] Assignee: United States Steel Corporation, Pittsburgh, Pa.

[21] Appl. No.: 627,401

[22] Filed: Oct. 30, 1975

[51] Int. Cl.[2] ..... E04H 17/14

[52] U.S. Cl. ..... 256/19; 174/158 F

[58] Field of Search ..... 256/10, 19; 174/45, 174/158 F, 149 R

[56] References Cited

U.S. PATENT DOCUMENTS

| | | | |
|---|---|---|---|
| 809,743 | 1/1906 | Petery | 174/149 R |
| 2,278,852 | 4/1942 | Hoffman | 174/158 F |
| 2,821,365 | 1/1958 | Lach | 256/19 |

*Primary Examiner*—Doris L. Troutman

*Attorney, Agent, or Firm*—John E. Callaghan

[57] ABSTRACT

Versatile plastic fence posts are provided with improved wire engaging lugs. These wire engaging lugs permit easy assembly of electric wire fence and can also be used for line fence, with barbed wire, or with woven wire fabric.

12 Claims, 7 Drawing Figures

PLASTIC FENCE POSTS AND ENCLOSURES

BACKGROUND OF THE INVENTION

Animal enclosures in the form of fences are made from fence posts and wire. There are two classes of enclosures: permanent enclosures, e.g., posts are placed permanently and strung for extended restraint of the animals; temporary enclosures, where the fence line is moved after original erection. The principal types of wires used in both types of enclosures are line wire, barbed wire, electric wire and woven wire fabric. In keeping heavy animals, such as cattle, hogs, and sheep, the temporary enclosures are used for marking off pasture or feed lots. The permanent enclosures are used for penning these animals as well as domestic pets. The brushing of animals against fence posts, pushing of the animals on the wire materials, and action of corrosion from fertilizers causes difficult maintenance problems. In addition, the need for insulators with electric wire, the reuse of implanted posts and the durability for permanent posts require a variety of fence post types and designs. It is among the objects of this invention to provide durable fence posts and enclosures where the fence post has wire engaging lugs that can be used with a variety of types of wires. Particularly as applied to electric wire enclosures, it is an object of this invention to provide self-insulating fences by having fence posts with improved wire engaging means so that insulators are unnecessary.

SUMMARY OF INVENTION AND DRAWINGS

This invention concerns wire engaging lugs for fence posts. These are formed so that the portion of the lug adjacent the fence post is narrower than the portion extending outwardly from the fence post. Thus formed, the lugs act as self-insulating supports for electric wires and as stops when other fence wire types are used. Enclosures of these posts with wire are thus available for even heavy animals.

This invention is illustrated in the following Figures.

DETAILED DESCRIPTION OF THE INVENTION

The wire engaging lugs are short projections on the front face of the fence post. In this invention, these are molded integrally with the fence post. The lugs are spaced along the face of the fence post to accommodate the wire. Typically, these spacings will be in the range of 1.5 to 10 inches. These lugs may be used with standard plastic fence posts. A preferred construction combines these lugs with the improved fence post set forth in U.S. application Ser. No. 623,299, filed Oct. 17, 1975, Inventor Byron W. Rose; the following detailed description is made in reference to this preferred embodiment.

Figure 1:
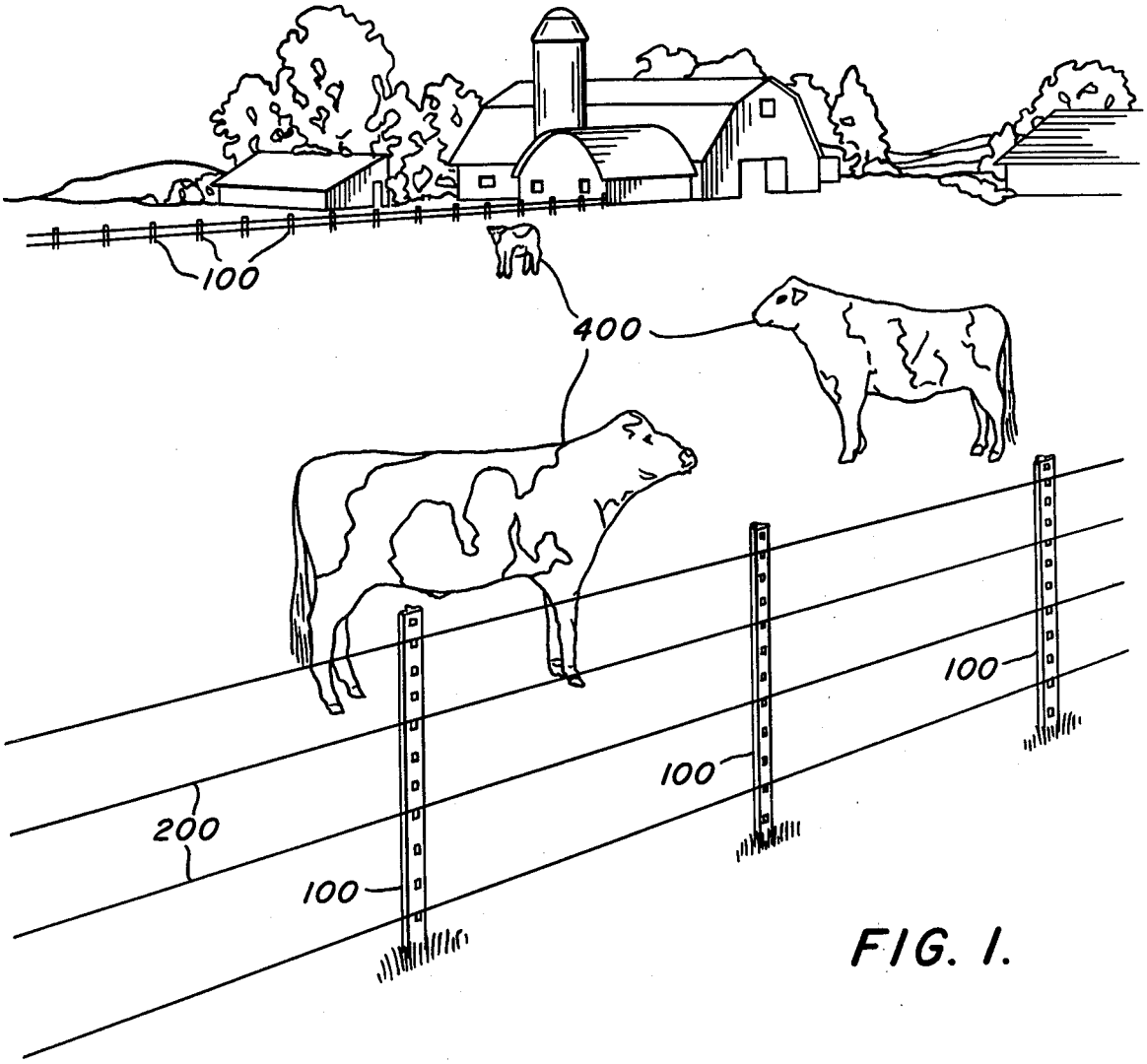
FIG. 1 depicts an enclosure for cattle.

The fence posts are long columnar members made by injection molding thermoplastic resins. In length the posts may range from 3 to 9 feet. For fully implanted, permanent use, the post 100 as shown in FIG. 1 may be sunk up to half of its length. With large animals such as cattle 400 the free end of the post may be about 5 feet. The shorter posts are also used for staking vegetables.

Injection molding is a technique where molten thermoplastic resin is forced into a mold under high pressure and then cooled to form a shaped object; it is used for these posts to achieve the geometric shapes for the wire engaging lugs of this invention. The thermoplastic resin materials are especially those which are tough, have good weatherability and are electrical insulators. Especially preferred are polyolefin resins, such as high density polyethylene, polypropylene and the like. These may be solid resin materials or they may be partially foamed by the use of chemical blowing agents. Colorants and fillers may be present. The inorganic oxides and silicates are fillers that may be used in up to 30% by weight of the resin. Color coded posts can be made by suitable choice of coloring materals. The resin formulation is selected to give weights not in excess of 4 pounds, preferably 3 pounds, for posts 78 inches in length. Shorter posts will have corresponding lower weights.

The post 100 has a top section 102, and a bottom section 103. The top section is at least half of the total length of the post. The post illustrated in FIGS. 1–3 has an overall length of 78 inches with the illustrations approximately to scale in FIGS. 2–7. There is a front flange 104, a rear flange 105 and a web 106. The web extends from the front flange through to a short distance beyond the rear flange. For this length, the front flange would have a width of 1½inches; the rear flange, 13/16 inch; the web, 9/32 inch. The web ends ¼ inch beyond the rear flange. Lateral thicknesses for the front flange and rear flange are 3/16 to ¼ inch while that of the web is 5/16 inch. The rear flange has a width in the range of 0.15 to 0.75 times that of the front flange; this gives adequate stiffness to the post and yet does not interfere with the releasability of the post when used for making temporary enclosures.

Figure 3:
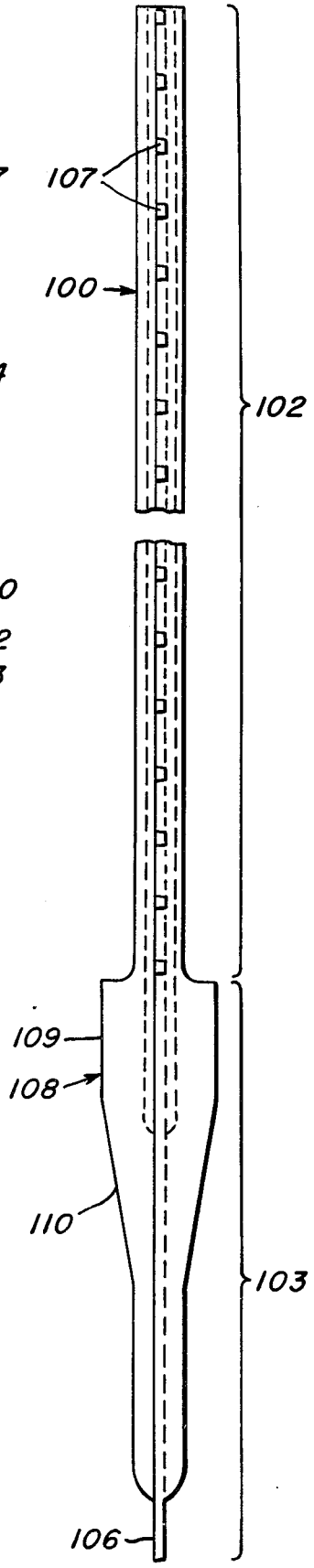
FIG. 3 is a front elevation of the fence post in FIG. 2.

The bottom section of the post contains at least one integral anchor plate 108 extending outwardly from one of the flanges, preferably the front flange 104. This support plate furnishes upright support to the member. As shown, this plate has a rectangular section 109 and an adjacent trapezoidal section 110 converging towards the end of the flange. The area and shape of the support plate affects the force necessary to remove the post and to resist deflection in the ground. Where the trapezoidal section is at least as long as the rectangular section, it has been found that the post can be removed after implantation with relative ease yet the post will resist movement from deflection even in soft ground. In FIG. 3, the rectangular section is 3½ inches wide and 33/16 inches long; the trapezoidal section converges for a distance of 5¾ inches to the flange. Below the integral anchor plate, the front flange extends for another 5¼ inches.

Figure 2:
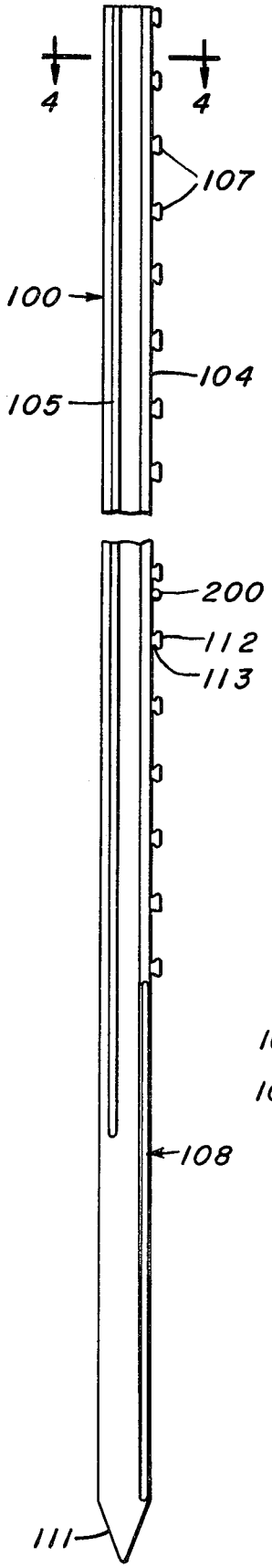
FIG. 2 is a left elevation of a fence post.
Figure 4:
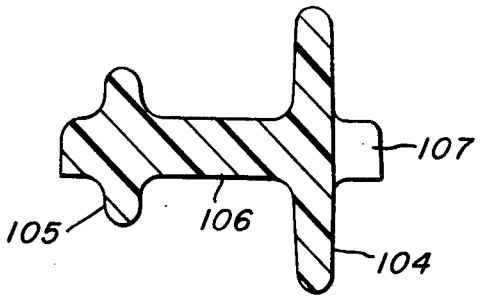
FIG. 4 is a full cross section along the line 4—4 of FIG. 2.

The wire engaging members or lugs 107 project outwardly from the front flange. These members are used either as wire supports or as stops to restrain wire movement. The front flange, rear flange and web are dimensioned so that conventional U-shaped clips can be placed on the post from the rear and then bent to snugly hold the wire against the post; the typical dimensions are shown in FIG. 4. With the clips, both woven wire fabric and line wire can be fastened to the post. As shown by FIG. 2, the wire 200 will be held between adjacent engagement members 107. Where hogs are penned in an enclosure, this has the advantage that rooting by the animals can only move the wire a short distance along the post and the fence line is kept intact.

Figure 7:
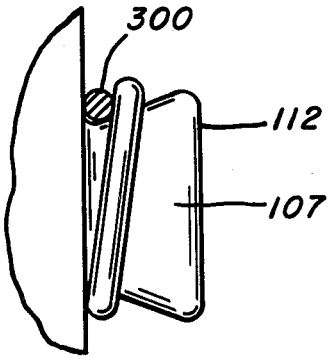
FIG. 7 is an enlarged elevation of an assembly of wire and the wire engaging lug shown in FIG. 5.

These lugs have a width adjacent the front face of the fence post that is sufficient to resist the forces of tension from the wire. The shape will allow frictional engagement between the wire and the lug to prevent slipping of the wires. As shown in FIG. 7, one full turn of wire around the lug is enough to give secure support. Because the fence post is plastic, these posts are self-insulating when used in electrified fence. FIG. 6 illustrates a "T-shaped" lug 507. The outer portion 512 is rectangular in shape, while the inner portion 513 is generally cylindrical. The "T-shaped" lug will generally have a minimum width across the inner portion 513 that is thicker than the more gradually shaped inner portion 113 for the lug 107 shown in FIG. 5. This width is necessary to accommodate the sharp change in direction of the flowing plastic when the post is molded.

The lugs are disposed along the length of the fence post. These generally are in the region of the portion of the post above the expected ground level. For the post in FIGS. 1–3, this corresponds to the top section 102. Where the lugs are spaced 1.5 to 3.0 inches apart, there is a sufficient number so that the post may be used with woven wire fabric as well as electric wire or barbed wire. In this case, the wire fabric will utilize most of the available lugs, while the electric wire or barbed wire will use one or more appropriately spaced lugs. The spacing of the lugs will allow the farmer to achieve the proper height and number of strands needed to confine certain types of animals.

The preferred structure of the wire engagement member is shown in enlarged view in FIG. 7. This member has a width adjacent the front flange that is less than its width at point 112 extending forwardly from the front flange. The inclination towards the front flange from this differential in widths is deep enough to engage the wire being strung between posts. As shown in FIG. 7, the wire can be simply wrapped around the member, and with electrified fence wire, these thermoplastic resin posts can be used without insulators to make an electrified fence. Because the post is injection molded, a preferred shape for the wire engaging member has continuously sloping upper and lower sides.

Figure 5:
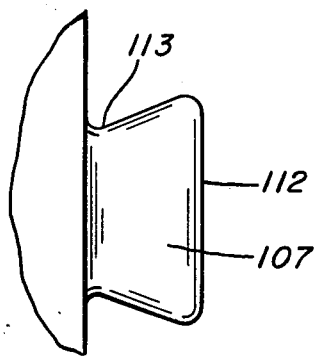
FIG. 5 is an enlarged elevation of the wire engaging lug shown in FIG. 2.
Figure 6:
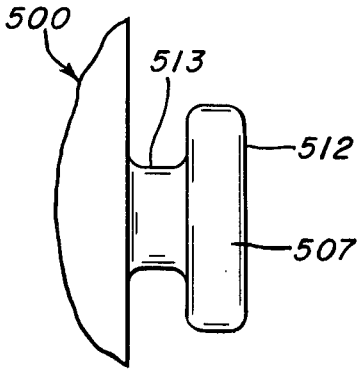
FIG. 6 is an enlarged elevation of an alternative embodiment of the wire engaging lug shown in FIG. 2.

For the lug shown in FIGS. 4, 5 and 7, the thickness is 5/16 inch and overall length is ¼ inch. The width of the outer portion is ½ inch; the width of the inner portion is ⅜ inch. Its sides are inclined at an angle of 20°–30° from the horizontal. This large width to length ratio of these lugs allows for maximum strength and adequate clearance for the wire.

With this invention, enclosures can be made to hold cattle. By the action of the animals brushing, scratching or leaning against the fence posts, there is considerable deflection within the limits of the wire fabric. The top of the implanted fence post may be deflected and by the features of this invention, it will be rebound to an upright position, keeping the fence intact. The polyolefin resins are slippery, and in the smooth walled fence posts described above, these posts deter cattle from using them as scratchers. The combination of anchor plate, web and flanges gives good upright support to the post; vertical loads on the attached wire of as much as 200 pounds can be held without deflection.

It can be seen that enclosures according to this invention may have a majority of their fence posts of the form described for this invention. Particularly, the straight line sections of the enclosure may have these plastic fence posts while at corner points, heavy section members may be used, such members are typically 8 inches dia. wood posts or their equivalent. In the nonelectric wire enclosures, grounding may be provided by having interspersed steel fence posts or by providing ground wires or rods fastened to the wire portion of the fence. Thus, although this invention has been described in terms of a specific device, it is intended to encompass such variations in fence post design and enclosure structures as would appear routine to one of skill in the art.

We claim:

1. In a fence post having an integral anchor plate in its bottom section and being a thermoplastic member, the improvement comprising a plurality of integrally molded wire engagement lugs disposed on the front of said post, said lugs being shaped elements having a width which is narrow adjacent the front face and gradually increase to a wider width at a point extending forwardly from the front face, the relative increase in width being sufficient to cause the sides of said lug toward said front face to have a depth to frictionally engage one full turn of wire about said lug for securing said wire against said post.

2. The fence post of claim 1 wherein the length of said lug from the front face is approximately equal to the width of said lug.

3. The fence post of claim 1 wherein the sides of said lug are inclined towards each other in the direction of said post.

4. The fence post of claim 1 wherein the lugs are T-shaped.

5. The fence post of claim 1 wherein the cross section of the post is dimensioned to receive U-shaped clips that extend from one side of the front of said post rearwardly around to the other side of said post, which clips have oppositely disposed extensions for engaging wire.

6. The fence post of claim 1 wherein the post is in the form of a fence post capable of returning to an upright position when deflected after implantation comprising an injection molded thermoplastic resin member having a top section extending more than half the length of the member, and a bottom section, the sections of said member being constructed with a front flange, a rear flange parallel to the front flange, a web intersecting the flanges, and a plurality of wire engaging members projecting forwardly from the front flange, the intersecting web having a lateral extend from the front flange to a short distance beyond the rear flange, the vertical extent and thickness of said web being greater than said flanges and the width of said front flange being greater than the width of said rear flange, the bottom of said web being a point, at least one of said flanges includes an outwardly extending integral anchor plate in the bottom section of the member, said integral anchor plate having a rectangular section and an adjacent trapezoidal section converging towards the end of said flange, the cross-sectional area of said integral anchor plate being sufficient to support said member in an upright position.

7. In a fenced enclosure including several fence posts and wire supported on said posts, where said posts have anchor plates in their bottom section and are molded thermoplastic members, the improvement characterized by a plurality of integrally molded wire engagement lugs disposed on the front face of said posts in the form of shaped elements having width which in narrow adjacent the front face and gradually increase to a wider width at a point forwardly from the front face, the relative increase in width being sufficient to cause the sides of said lug toward said front face to have a depth to frictionally engage one full turn of wire about said lug.

8. The enclosure of claim 7 where said wire is selected from the class of woven wire fabric, barbed wire, line wire and electrified wire.

9. The enclosure of claim 8 where said wire is electrified wire.

10. The enclosure of claim 7 where the support for said wire includes having wire wrapped around said lugs.

11. The enclosure of claim 7 where the support for said wire includes U-shaped members around said posts fixing said wire to said posts.

12. The enclosure of claim 11 wherein said wire is woven wire fabric.

* * * * *

UNITED STATES PATENT OFFICE

CERTIFICATE OF CORRECTION

Patent No. 4,070,007 Dated January 24, 1978

Inventor(s) Dale R. Minor, Byron W. Rose and William R. Vivian

It is certified that error appears in the above-identified patent and that said Letters Patent are hereby corrected as shown below:

Column 2, line 55, change "33/16" to -- 3-3/16 --.

Column 4, line 49, change "extend" to -- extent --.

Column 4, line 68, change "in" to -- is --.

Signed and Sealed this

*Eleventh* Day of *July 1978*

[SEAL]

*Attest:*

RUTH C. MASON
*Attesting Officer*

DONALD W. BANNER
*Commissioner of Patents and Trademarks*